US007353813B2

(12) United States Patent
Shiraishi

(10) Patent No.: US 7,353,813 B2
(45) Date of Patent: Apr. 8, 2008

(54) SPARK IGNITION ENGINE, CONTROLLER FOR USE IN THE ENGINE, IGNITION COIL FOR USE IN THE ENGINE

(75) Inventor: Takuya Shiraishi, Tokyo (JP)

(73) Assignee: Hitachi, Ltd., Tokyo (JP)

( * ) Notice: Subject to any disclaimer, the term of this patent is extended or adjusted under 35 U.S.C. 154(b) by 0 days.

(21) Appl. No.: 11/352,346

(22) Filed: Feb. 13, 2006

(65) Prior Publication Data

US 2006/0201475 A1 Sep. 14, 2006

(30) Foreign Application Priority Data

Mar. 14, 2005 (JP) ..... 2005-070256

(51) Int. Cl.
*F02P 13/00* (2006.01)
*F02P 15/08* (2006.01)

(52) U.S. Cl. ..... 123/634; 123/637; 123/640

(58) Field of Classification Search ..... 123/634, 123/636, 637, 640
See application file for complete search history.

(56) References Cited

U.S. PATENT DOCUMENTS

| | | | | |
|---|---|---|---|---|
| 4,393,849 | A * | 7/1983 | Sae | 123/536 |
| 5,140,970 | A * | 8/1992 | Akaki et al. | 123/620 |
| 5,193,515 | A * | 3/1993 | Oota et al. | 123/637 |
| 6,283,104 | B1 | 9/2001 | Ito et al. | |
| 6,397,827 | B1 | 6/2002 | Kato et al. | |
| 6,659,075 | B1 * | 12/2003 | Tokuyasu et al. | 123/301 |
| 6,705,302 | B2 * | 3/2004 | Meinders | 123/620 |
| 2003/0034017 | A1 * | 2/2003 | Wilkinson | 123/620 |
| 2004/0168671 | A1 * | 9/2004 | Yamaguchi et al. | 123/305 |

FOREIGN PATENT DOCUMENTS

| | | |
|---|---|---|
| EP | 1 406 003 A1 | 4/2004 |
| JP | 63-268978 A | 11/1988 |
| JP | A 9-112398 | 4/1997 |
| JP | 2002-206473 A | 7/2002 |

OTHER PUBLICATIONS

European Search Report dated Oct. 31, 2007 (Five (5) Pages).

* cited by examiner

*Primary Examiner*—Erick Solis
(74) *Attorney, Agent, or Firm*—Crowell & Moring LLP

(57) ABSTRACT

An engine generating two or more ignition sparks by the same spark plug, which can avoid a torque reduction caused by misfire of main ignition, can start firing and burning at proper timing depending on operating conditions, and can reduce misfires. A novel controller and a novel ignition coil adapted for realizing that engine are also provided. One spark plug and at least one ignition coil are provided per cylinder. When performing a plurality of ignitions during the compression stroke in the cylinder, before main ignition to start firing and burning at proper timing depending on operating conditions of the engine, preliminary pre-ignition is performed to form a fire seed around the spark plug. The main ignition is then performed to cause main burning. Misfire is avoided, appropriate torque can be generated, and combustion stability can be improved.

2 Claims, 10 Drawing Sheets

SPARK IGNITION ENGINE, CONTROLLER FOR USE IN THE ENGINE, IGNITION COIL FOR USE IN THE ENGINE

BACKGROUND OF THE INVENTION

1. Field of the Invention

The present invention relates to a spark ignition engine, and more particularly to a controller used in the engine for ignition control and an ignition coil for use in the engine.

2. Description of the Related Art

In a spark ignition engine, it is known to perform spark ignition plural times for the purpose of improving ignitability and combustion stability. For example, JP-A-9-112398 (Patent Document 1) discloses a technique of performing spark ignition plural times during a compression stroke in an engine, which is provided with one spark plug and one ignition coil per cylinder, in order to prevent deterioration of the combustion stability when the ignition timing is advanced for some reason.

Also, JP-A-2002-206473 (Patent Document 2) discloses a technique of providing two ignition coils per cylinder and increasing the degree of freedom in setting the ignition interval in order to prevent a chance of firing from being lost during a non-discharge period that is generated when the spark ignition is performed plural times.

SUMMARY OF THE INVENTION

However, any of those two disclosed techniques is based on the concept of employing first ignition as main ignition and starting the firing and burning by the first ignition. Stated another way, that concept is intended to surely start the firing with second ignition if the first ignition is misfired for some reason.

Therefore, the first ignition timing is set to proper timing that is decided depending on operating conditions, but the second ignition timing is set to timing that is retarded from the proper timing. Accordingly, even when misfire of the first ignition is compensated by the second ignition, actual firing is made at the timing retarded from the proper timing. This may lead to a risk that torque generated by an engine is reduced and the combustion stability is deteriorated.

Stated another way, in spite of the ignition being performed plural times after the first main ignition, if the ignition timing is not proper, the combustion stability cannot be improved to a satisfactory level although a chance of firing is increased.

One object of the present invention is to provide an engine in which firing and burning can be started at proper timing depending on operating conditions and misfires are reduced.

Another object of the present invention is to provide a novel controller and a novel ignition coil which are adapted for realizing the above object.

To achieve the above objects, in the engine according to the present invention, a preliminary pre-ignition is performed before the timing of main ignition.

More specifically, at least one preliminary pre-ignition is performed before main ignition with smaller ignition energy than that of the main ignition.

In order to perform the preliminary pre-ignition before the main ignition, a controller supplies a current pulse plural times to an ignition coil for a cylinder during a compression stroke, and sets the last one of the plurality of current pulses to have a maximum pulse width.

Further, the ignition coil may be constituted by one or two ignition coils. When two ignition coils are employed, they are constituted such that one coil supplies, to a spark plug, comparatively small ignition energy for performing the preliminary pre-ignition, and the other coil supplies, to the spark plug, comparatively large ignition energy for performing the main ignition.

The two ignition coils are preferably accommodated in one housing.

Also, preferably, one ignition coil is the cylindrical type capable of being inserted in a plug hole, and the other ignition coil is a horizontally oriented coil disposed at a top of the cylindrical ignition coil.

Thus, it is possible to provide an engine capable of reducing the main ignition and suppressing a reduction of torque caused by misfire.

BRIEF DESCRIPTION OF THE DRAWINGS

FIG. 13 is a sectional view showing the structure of a hybrid coil in which a preliminary pre-ignition coil and a main ignition coil are integrally built in;

DESCRIPTION OF THE PREFERRED EMBODIMENTS

Figure 1:
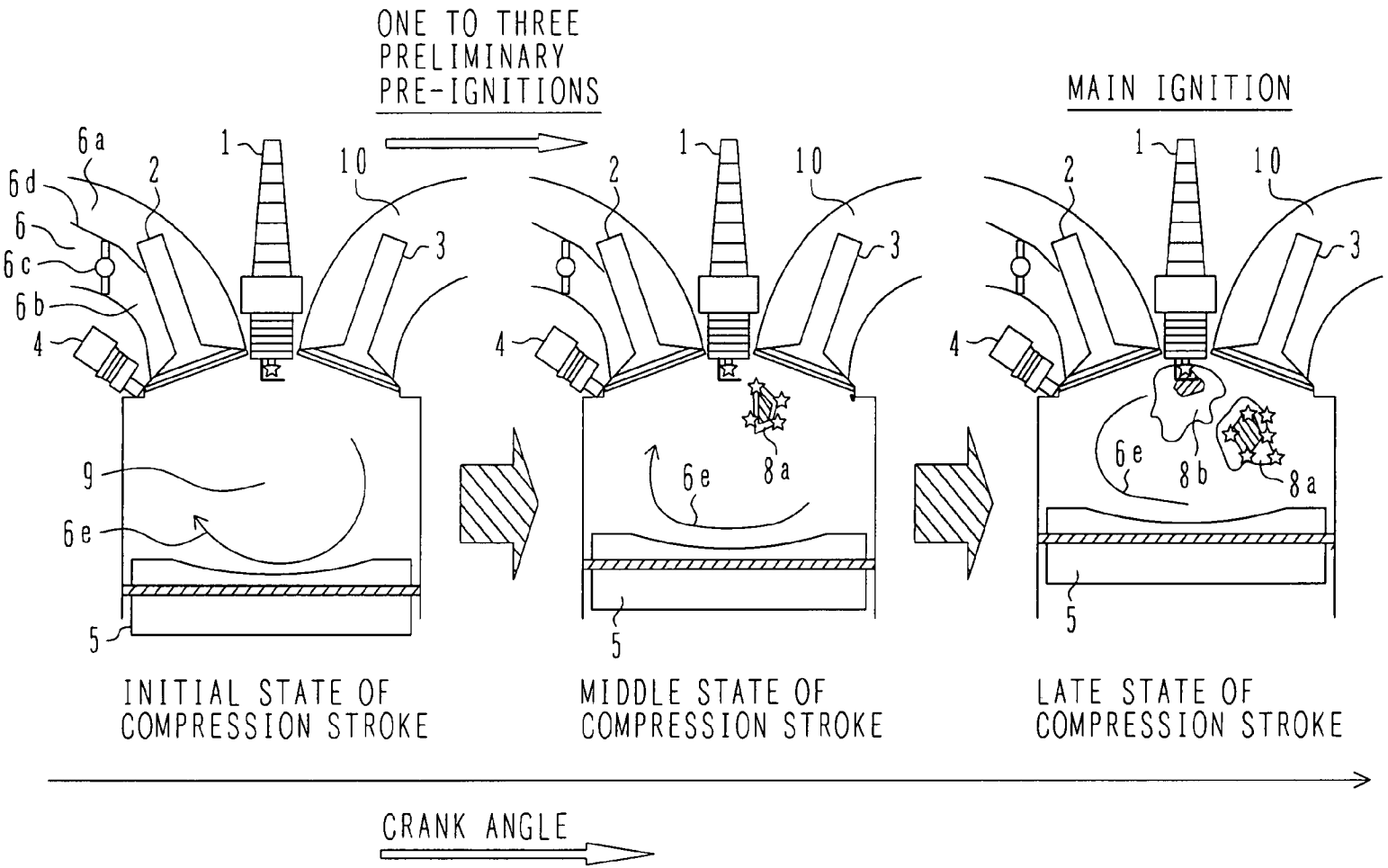
FIG. 1 is an explanatory view for explaining the principle of combustion control by twice ignitions according to the present invention.

The basic concept of an embodiment in accordance with the principle of the present invention will be described below with reference to FIG. 1. An engine according to the embodiment has one spark plug 1 per cylinder, which is positioned substantially at a center above a combustion chamber 9. The combustion chamber 9 is enclosed by an intake valve 2, an exhaust valve 3 and a piston 5, and a gas mixture introduced to the combustion chamber 9 is fired by the spark plug 1 and burnt to drive the piston 5 up and down, thereby producing torque. In this embodiment, the present invention is applied to an engine of the so-called in-cylinder direct fuel injection type that an injector 4 directly injects fuel into the combustion chamber 9. FIG. 1 shows successive situations during the compression stroke of the engine in time serial sequence. First preliminary pre-ignition supplies ignition (arc) energy to such a small extent that the gas mixture in the combustion chamber 9 is not entirely fired and burnt, but a spark is generated in a spark plug gap. Because the ignition energy of this spark is small, a flame generated at the first ignition timing is cooled through radiation of heat to the surroundings and does not spread over an entire space of the combustion chamber 9. The generated flame just forms a fire seed 8*a* around the spark plug. The fire seed 8*a* is moved from the spark plug gap with air motion 6*e* in the combustion chamber 9, which is produced by an air-motion producing mechanism 6 during the intake stroke, so as to activate the gas mixture. The air-motion producing mechanism 6 is constituted by an intake passage divided into two passages 6*a* and 6*b* by a partition 6*d*, and an open/close valve 6*c* s disposed in one of the two passages to open and close it. In the state of the open/close valve 6*c* being closed, intake air enters the combustion chamber 9 through only the passage 6*a*. As a result, the air motion 6*e* is produced in the form of a flow circulating within the combustion chamber 9. When the partition 6*d* vertically divides the intake passage into upper and lower passages, the circulating flow produces tumble air-motion (vertical vortex) in the combustion chamber. When the partition 6*d* horizontally divides the intake passage into left and right passages, the circulating flow produces swirl air-motion (horizontal vortex) in the combustion chamber.

Thereafter, the not-yet reacted gas mixture moves to an area around the gap of the spark plug 1, and second main ignition 8*b* is performed. The timing of the second main ignition 8*b* is set to proper timing depending on operating conditions. Also, the second ignition supplies larger ignition energy than that in the first ignition. As a result, the gas mixture in the whole of the combustion chamber 9 is fired and burnt to push the piston 5 downward, thereby generating torque. Because the second main ignition 8*b* is performed in the state where the gas mixture in the combustion chamber 9 is partly activated by the first preliminary pre-ignition (fire seed) 8*a* and is more apt to burn, ignitability is improved and misfire is prevented more positively. Also, because the timing of the second main ignition 8*b* is set to the proper timing depending on operating conditions, it is possible to avoid a reduction of the torque generated and to prevent the occurrence of combustion variations. The foregoing is an important point in this embodiment of the present invention. While the above description is made in connection with the embodiment in which the number of ignitions is set to two (one preliminary pre-ignition and one main ignition), the number of ignitions is not limited to two. The preliminary pre-ignition may be performed twice or triple depending on operating conditions, e.g., an engine revolution speed. Anyway, the last one of ignitions performed plural times is regarded as corresponding to the second main ignition 8*b* in FIG. 1 and is set so as to provide larger energy than the other one or more preliminary pre-ignitions. Additionally, reference numeral 10 denotes an exhaust pipe. When the exhaust valve 3 is opened in the engine exhaust stroke, combustion gas is exhausted through the exhaust pipe 10.

Figure 2:
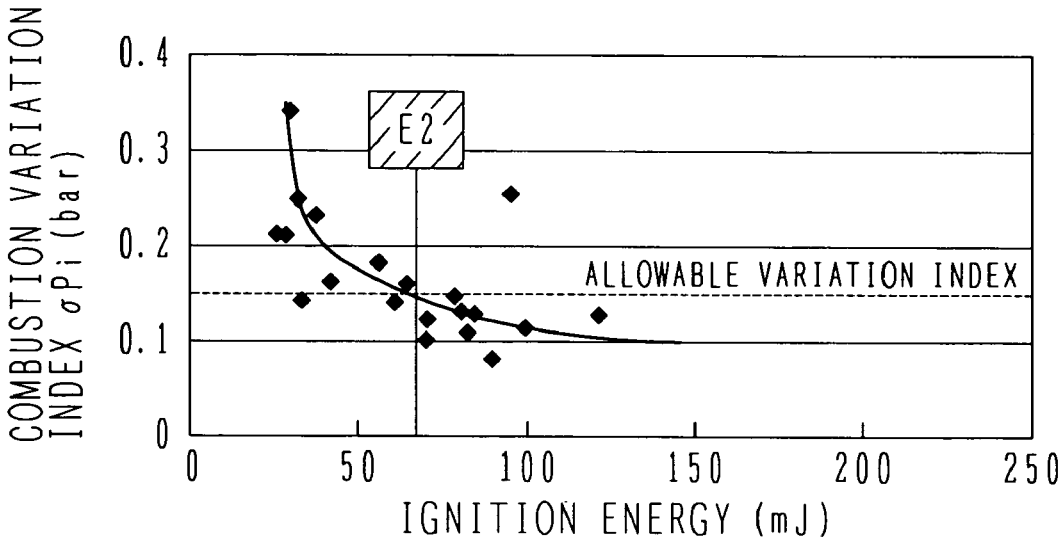
FIG. 2 is a graph showing the relationship between ignition (arc) energy and a combustion variation index σPi.

A method of setting the ignition energy will be described below. FIG. 2 is a graph showing the relationship between ignition (arc) energy and a combustion variation index σPi. The combustion variation index σPi is related to torque variations of the engine and must be held not larger than an allowable variation level because a driver feels discomfort if σPi exceeds the allowable variation level. In a region where the ignition energy is small, σPi is increased to such an extent as exceeding the allowable variation level. Accordingly, the ignition energy not smaller than E2 (mj) at a minimum is required in order to hold σPi not larger than the allowable variation level. For that reason, the second main ignition shown in FIG. 1 is set to have the ignition energy of not smaller than E2 (mJ). On the other hand, the first preliminary pre-ignition is intended to produce the fire seed around the spark plug gap and to partly activate the gas mixture. Therefore, the ignition energy of the first ignition is set to a level smaller than E2 (mJ).

Figure 3:
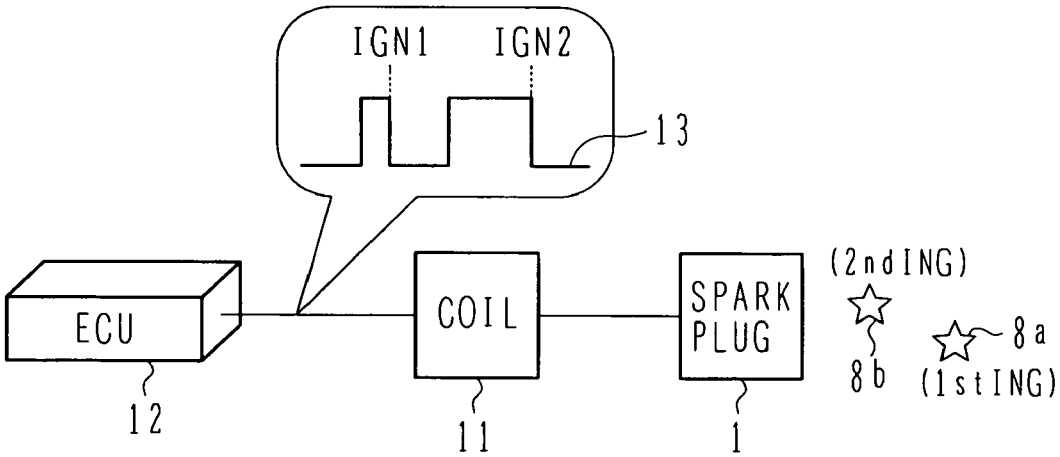
FIG. 3 is a schematic view for explaining the concept of an ignition controller according to the present invention.

FIG. 3 is a schematic view for explaining the basic concept of an ignition controller of this embodiment. An ECU 12 is an engine control unit and executes not only ignition control, but also control of fuel injection, an air amount, etc. based on signals from various sensors. A waveform denoted by 13 represents an ignition signal outputted from the ECU 12 to the ignition coil 11. In this embodiment, IGN1 in the ignition signal corresponds to the preliminary pre-ignition, and IGN2 corresponds to the main ignition. In other words, the first ignition (to produce the fire seed) 8*a* and the second (main) ignition 8*b* are performed at energy and timing provided by the ignition signal 13. The ignition coil 11 and the spark plug 1 are each disposed one per cylinder. In the case of a multi-cylinder engine, the engine includes the ignition coil and the spark plug in number corresponding to the number of cylinders. Though not shown in FIG. 3, the ECU 12 outputs separate ignition signals for individual cylinders in the ignition control.

Figure 4:
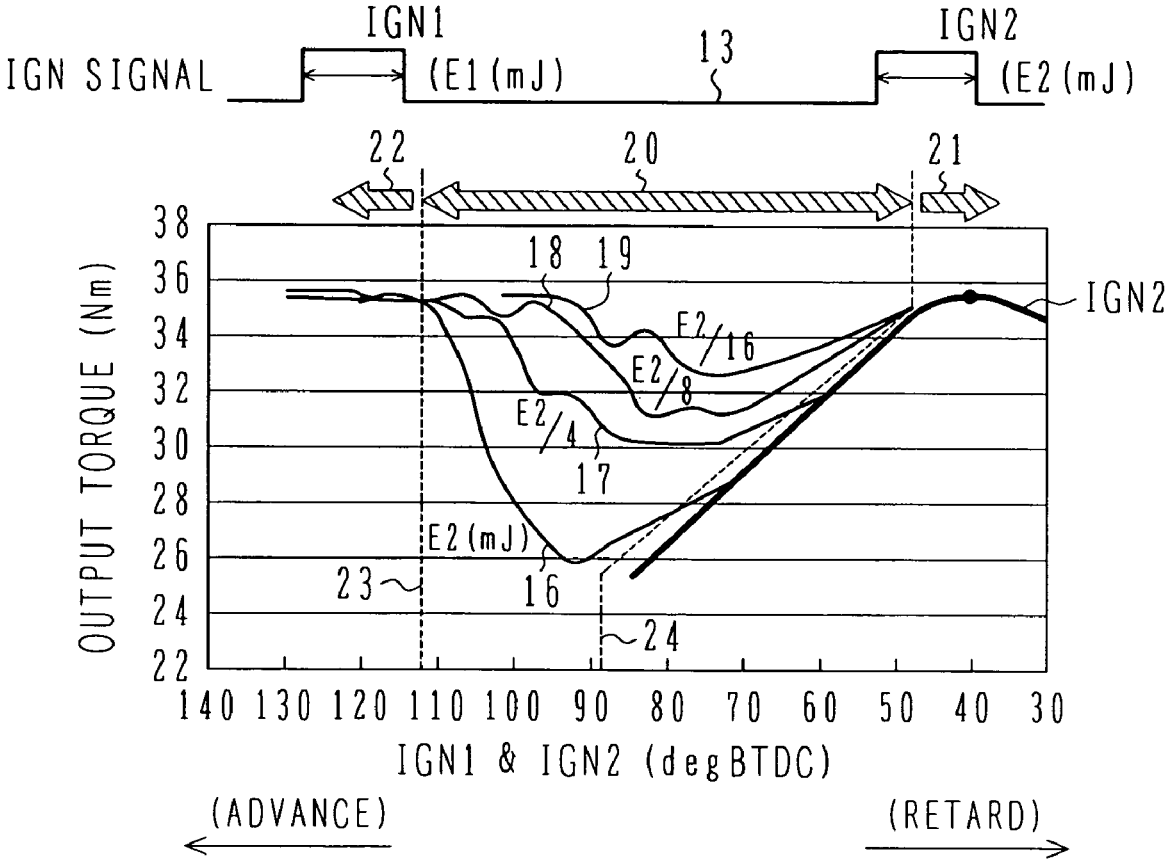
FIG. 4 is a graph for explaining a method of setting an interval between preliminary and main ignitions.

A method of setting an interval between the preliminary pre-ignition and the main ignition will be described below. FIG. 4 is a graph showing the relationship between ignition timing and engine torque under constant operating conditions. The horizontal axis indicates the timing of the first ignition and the second ignition. In the graph, a direction toward the right represents the ignition retard side, and a direction toward the left represents the ignition advance side. The ignition signal 13 is indicated above the graph. The magnitude of the ignition energy can be set by changing the pulse width of the ignition signal 13. The pulse width of the second ignition is set to have the ignition energy of E2 (mJ) as described above with reference to FIG. 2. The graph shows the results obtained when the energy of the first ignition is set to various values. A thick solid line 15 represents a torque curve when firing and burning are made only by the main ignition without performing the preliminary pre-ignition. For the convenience of explanation, that case is here denoted by the IGN2 case. The optimum ignition timing under the current operating conditions is a point in time indicated by a mark "●" in FIG. 4. The engine torque is reduced when the ignition timing is earlier or later than the optimum ignition timing. The reason why the engine torque is reduced when the ignition timing is earlier than the optimum ignition timing is as follows. As the burning starts at earlier timing, the burning comes to an end at earlier timing. Therefore, the cylinder pressure reaches a peak before the top dead center, and the pressure generated by the combustion cannot be efficiently converted to torque. In such a case, the piston during the compression stroke has to move upward against the cylinder pressure raised by the combustion, and loss is further increased.

Solid lines 16-19 represent the results obtained when the preliminary pre-ignition IGN1 is performed in various ways while the ignition timing of IGN2 is fixed to the point "●". Here, ignition energy E1 (mJ) and ignition timing of IGN1 are changed. The solid line 16 represents the case of E1=E2 (mJ). When the ignition timing of IGN1 is gradually advanced, the engine torque is reduced substantially in the same manner as that indicated by the thick solid line 15. However, the engine torque tends to restore from some advanced point, and when the ignition timing of IGN1 is advanced beyond a broken line 23, the engine torque is restored to a value comparable to that at the point "●".

Such a phenomenon can be understood as follows.

(1) First, when the ignition energy of IGN1 is set to E1=E2 (mJ), the engine torque is changed with advance of IGN1 while tracing the torque curve 15 representing the case where only ING2 is advanced. Although IGN2 is also performed at the timing indicated by the point "●", the gas mixture in the combustion chamber is already burnt with IGN1 and hence IGN2 does not contribute to the combustion.

(2) Then, when IGN1 is further advanced to be performed in the range of from the broken line 24 to 23 (i.e., in a region 20), the fire seed formed by the action of the preliminary pre-ignition IGN1 is diffused to the whole of the combustion chamber to assist firing and burning with the main ignition IGN2, whereby the engine torque starts to restore, in spite of the fact that the single ignition of only IGN2 cannot produce torque in such a region 20 because of misfire.

(3) When IGN1 is further advanced beyond the broken line 23 (i.e., it comes into a region 22), the action of IGN1 disappears and the firing is made only with IGN2 (in a region 21), whereby the engine torque is restored to the level indicated by the point "●". At this time, although the fire seed is formed by the preliminary pre-ignition IGN1, the interval between IGN1 and IGN2 is too large and the effect of the preliminary pre-ignition IGN1 does not act on the main ignition IGN2.

It is thus understood that the effect of the present invention appears when the timing of the preliminary pre-ignition IGN1 is set to fall between the broken line 23 and 24 (i.e., in the region 20).

However, because the formation of the fire seed and the activation of the gas mixture caused by the preliminary pre-ignition IGN1 consume a part of fuel, the amount of fuel consumed to form the fire seed has to be minimized. The amount of fuel consumed to form the fire seed is represented by the difference in engine torque relative that at the point "●". It can be confirmed from FIG. 4 that, when the ignition energy of IGN1 is reduced, a drop of the engine torque is also lessened corresponding to the ignition energy as indicated by the solid lines varying from 17 to 19. Accordingly, the feature of the present invention, i.e., reducing the energy of the preliminary pre-ignition, is important from the vewpoints of not only avoiding the firing at too earlier timing, but also effectively forming the fire seed.

Figure 5A:
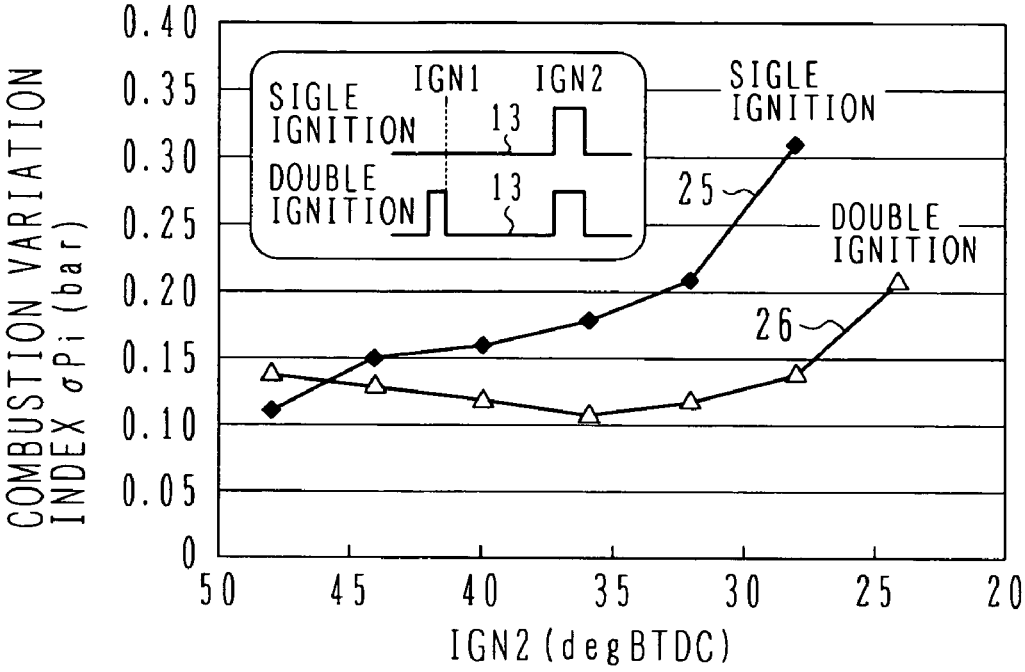
FIG. 5 is a graph for comparatively showing the engine performance between single ignition and double ignition.
Figure 5B:
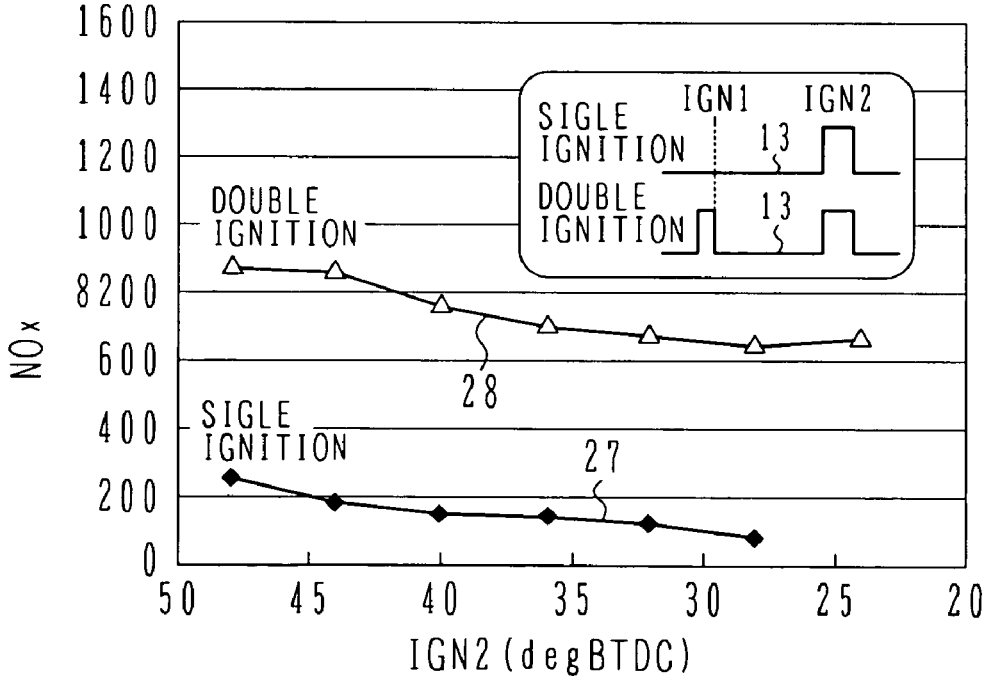
Figure 6A:
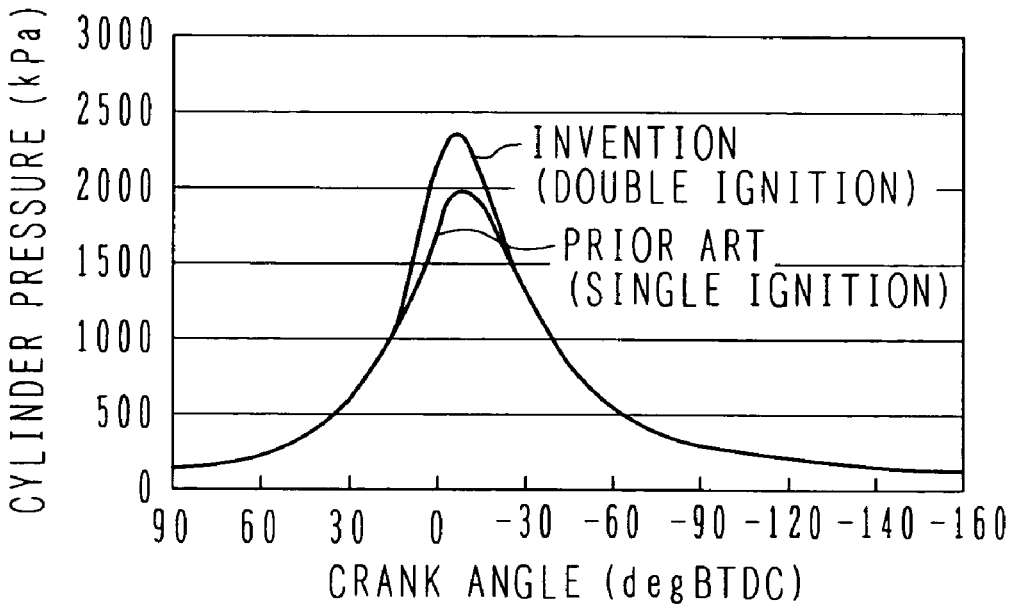
FIG. 6 is a graph for comparatively showing the engine performance between single ignition and double ignition.
Figure 6B:
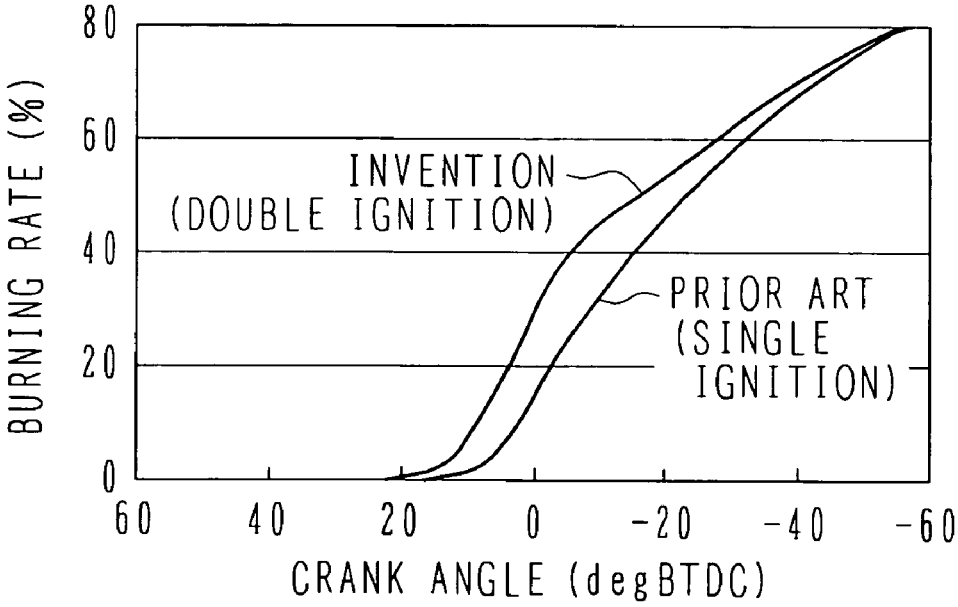

FIGS. 5 and 6 comparatively show the engine performance between the single ignition and the double ignition. The single ignition is performed using only IGN2 with the ignition energy of E2 (mJ). The double ignition is performed using the preliminary pre-ignition IGN1 and the main ignition IGN2. The ignition energy of IGN1 is set to E2/16 (mJ), the ignition energy of IGN2 is set to E2 (mJ), and the interval between IGN1 and IGN2 is set to fall between the broken lines 23 and 24 (i.e., in the region 20) in FIG. 4. FIG. 5 shows the results obtained when the ignition timing of IGN2 is changed. In the single ignition, when the ignition timing of IGN2 is gradually retarded, the combustion variation index σPi increases, i.e., deteriorates, monotonously as indicated by a solid line 25. On the other hand, in the double ignition, σPi tends to slightly decrease, i.e., improve, until some point as indicated by a solid line 26. However, if the main ignition IGN2 is too retarded, the degree of constant volume during the combustion is deteriorated and the combustion efficiency is reduced. For that reason, IGN2 is preferably retarded within the allowable combustion variation range. Further, the emission concentration of NOx is increased in the double ignition. This represents the fact that the burning velocity with the main ignition IGN2 is increased by the effect of the preliminary pre-ignition IGN1. FIG. 6 shows the cylinder pressure and the burning rate obtained when ING2 is set to a retard angle where σPi is the same between the single ignition and the double ignition. As seen from FIG. 6, the double ignition according to the present invention provides a higher cylinder pressure and a higher burning rate, i.e., a faster burning velocity in the initial stage of burning, than those in the single ignition (prior art). Thus, the double ignition enables makes it possible to further retard the ignition timing of IGN2 and to increase the combustion efficiency.

Figure 7:
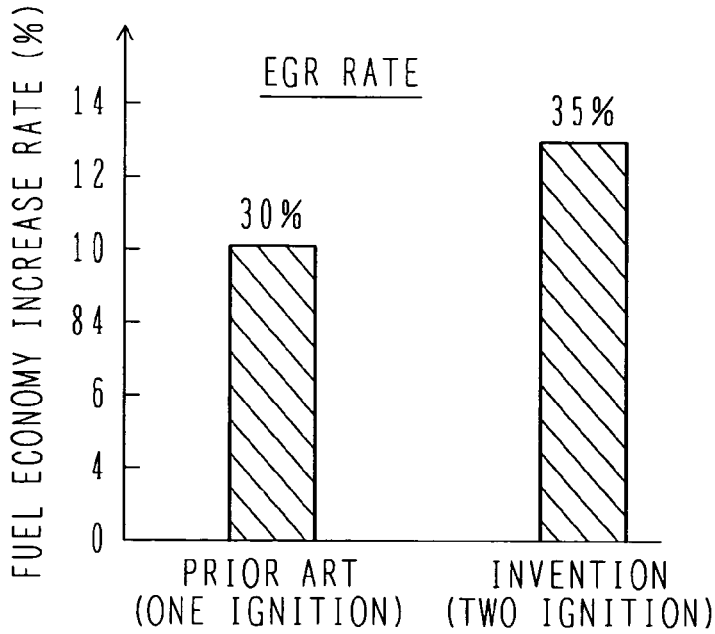
FIG. 7 is a graph for showing a fuel economy increase rate when the present invention is applied to stoichiometric combustion with EGR (Exhaust Gas Recirculation)

As one advantage obtained with the above-described embodiment of the present invention, an improvement of fuel economy in stoichiometric combustion with EGR (Exhaust Gas Recirculation) is expected. It is generally known that the burning velocity in stratified combustion employed in some of in-cylinder injection engines is faster than the burning velocity in stoichiometric combustion employed in most of port injection engines. This is because, in the stratified combustion, the gas mixture is concentrated around the spark plug and ignitability is increased. On the other hand, regarding the stoichiometric combustion, lean burn or EGR burn is employed in some cases from the viewpoint of improving fuel economy. In those types of combustion, however, the concentration of the gas mixture tends to become lean around the spark plug, whereby ignitability deteriorates and the burning velocity is reduced. As a result, combustion variations are increased, a lean level of the air/fuel ratio and an EGR rate are limited, and the improvement of fuel economy is impeded. By employing the technique for increasing the burning velocity based on the ignition control according to the present invention, the burning velocity during the EGR burn is increased and the combustion variations are suppressed, whereby σPi can be held low. Consequently, the EGR rate can be increased and the fuel economy can be improved. FIG. 7 shows an increase rate of fuel economy on the basis of on the increase rate in the case of not performing EGR. In the single ignition, the EGR rate is limited to 30% for the necessity of keeping the combustion variations within a predetermined limit, and therefore the increase rate of fuel economy is about 10%. In the double ignition, as a result of the above-mentioned effect, the EGR rate can be increased to 35% and therefore the increase rate of fuel economy is about 13%.

Figure 8A:
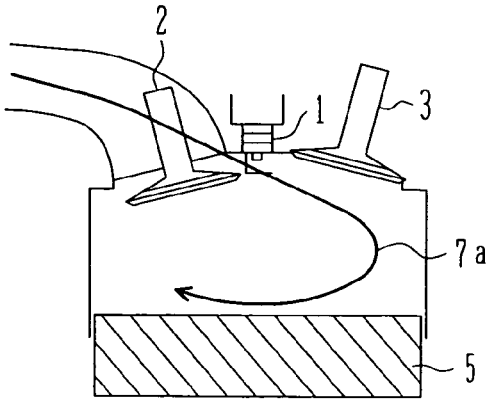
FIG. 8 is an explanatory view for explaining a characteristic of swirl air-motion.
Figure 8B:
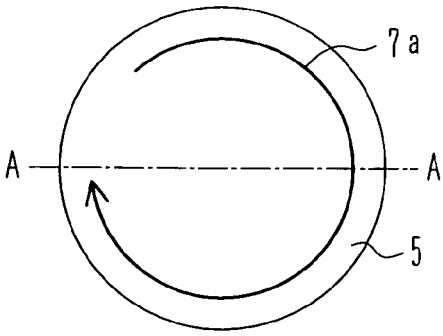
Figure 8C:
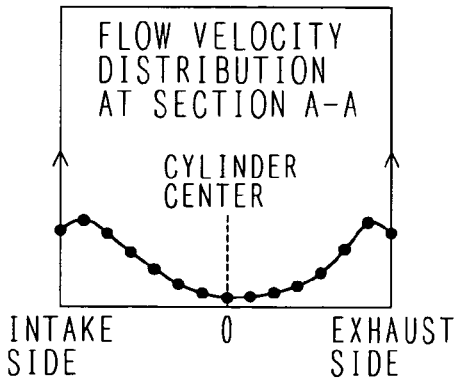

FIG. 8 is an explanatory view for explaining air motion 7*a* produced in the combustion chamber. The air motion 6*e* shown in FIG. 1 represents a vertical vortex that is produced in the combustion chamber and called tumble air-motion. FIG. 8 shows a horizontal vortex that is called swirl air-motion. With the swirl air-motion 7*a*, the flow velocity in a peripheral area along a cylinder wall surface of the combustion chamber is increased, while the flow velocity in a central area is relatively low. Taking into account such a characteristic, in the case of utilizing the swirl air-motion, the swirl air-motion is to be produced in a larger width to generate a flow around the spark plug so that the fire seed 8*a* formed by the preliminary pre-ignition is moved from the spark plug gap and is diffused to the whole of the combustion chamber. As a result, the fire seed 8*a* is caused to diffuse while circulating around the spark plug, and to become ready for waiting the main ignition 8*b*. In the case of the air motion being the tumble air-motion 6*e*, air motions having entered the combustion chamber through two intake ports (two intake valves) join into one air motion below the exhaust valve and descend toward an upper surface of the piston. Then, the air motion flows along the upper surface of the piston for return to the intake port side, and ascends from a position below the intake port toward the spark plug. Accordingly, the fire seed 8*a* is more easily apt to diffuse to the whole of the combustion chamber.

Figure 9:
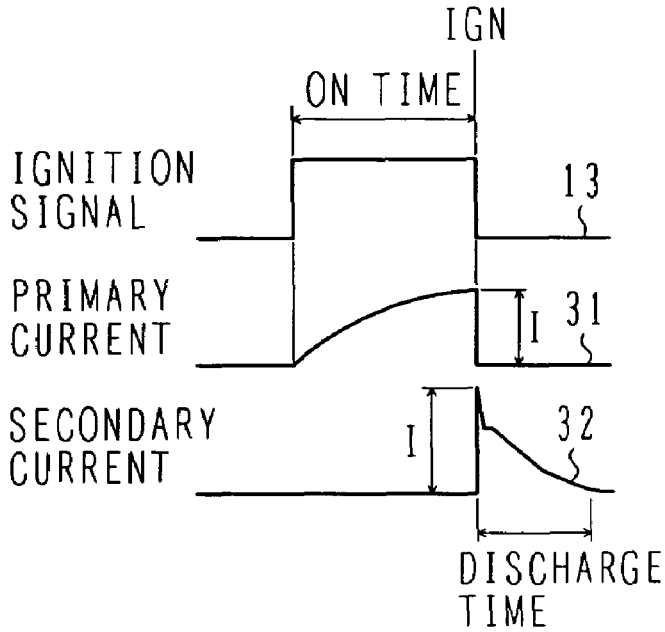
FIG. 9 is a chart for explaining the concept of single ignition.

FIG. 9 is a chart for explaining the concept of the single ignition. The pulse width (indicated by "On Time" in FIG. 9) of the ignition signal 13 controls a charge time of the ignition coil. During a period in which the ignition signal 13 is turned on, a primary current 31 flows through a primary coil, and when the ignition signal 13 is turned off, the primary current 31 is cut off. At the same time, a secondary current 32 flows through a secondary coil to discharge at the spark plug gap. A peak value i of the primary current 31, a peak value I of the secondary current 32, and a discharge time can be optionally set by adjusting parameters (such as a winding ratio between the primary coil and the secondary coil) used in design of the ignition coil.

Figure 10:
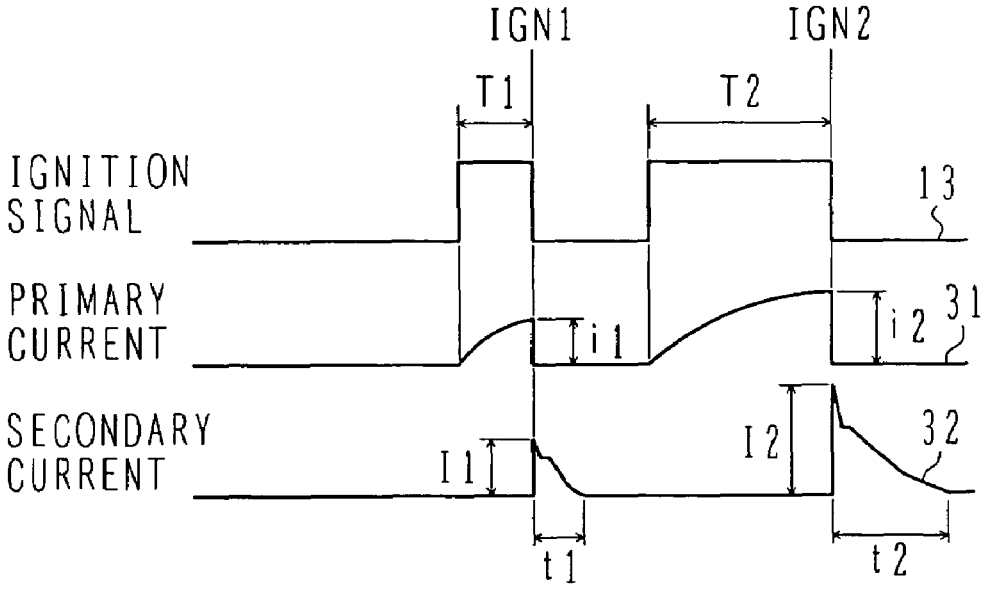
FIG. 10 is a chart for explaining the concept of double ignition.

FIG. 10 is a chart for explaining the concept of the double ignition. Charge and discharge operations for the ignition are basically similar to those described above with reference to FIG. 9. In FIG. 10, suffixes "1" and "2" are added corresponding to the preliminary pre-ignition IGN1 and the main ignition IGN2, respectively.

The ignition interval between IGN1 and IGN2 is denoted by ΔT and is defined by a formula (1) as follows:

$$\Delta T = IGN1 - IGN2 \text{ (unit: second)} \quad (1)$$

Though ΔT is changed depending on the operating conditions, the double ignition has to be inhibited when ΔT is too short. The reason is that, if charge (indicated by T2 in FIG. 10) for the main ignition IGN2 is started during discharge (indicated by t1 in FIG. 10) with the preliminary pre-ignition IGN1, the discharge with the preliminary pre-ignition IGN1 is stopped. In other words, the ignition mode is changed over depending on whether ΔT satisfies the following formula (2) or (3):

$$\Delta T > (T2 + t1) \text{: double ignition} \quad (2)$$

$$\Delta T \leqq (T2 + t1) \text{: single ignition} \quad (3)$$

(double ignition is inhibited)

ΔT represents a period during which the fire seed formed by the preliminary pre-ignition is diffused to the whole of the combustion chamber and to develop an action on main burning caused by the main ignition. Such a period is primarily affected by the engine revolution speed. Because of an ignition phenomenon being dominated by time, (IGN1−IGN2) has to be increased in terms of crank angle on an assumption that ΔT is set constant. However, as the engine revolution speed increases, the air motion in the combustion chamber is intensified and the diffusion of the fire seed with the preliminary pre-ignition is sped up, whereby the time during which the fire seed develops an action on the main ignition tends to shorten. As a result, (IGN1−IGN2) becomes substantially constant. With the experiments conducted by the inventor, the effect of the double ignition is confirmed until 2000 rpm.

Figure 11:
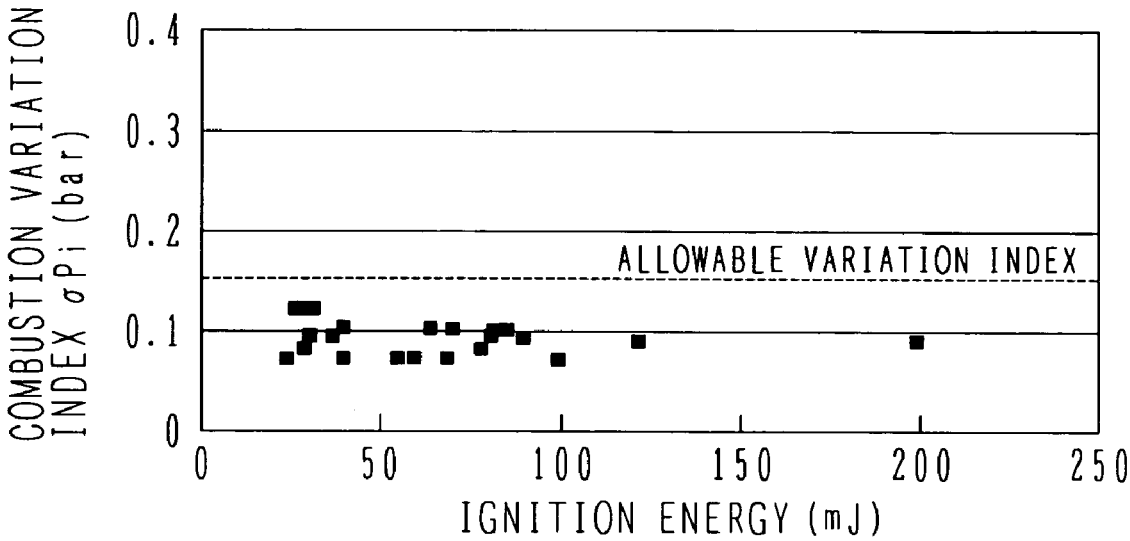
FIG. 11 is a graph showing the relationship between ignition energy and a combustion variation index σPi.
Figure 12:
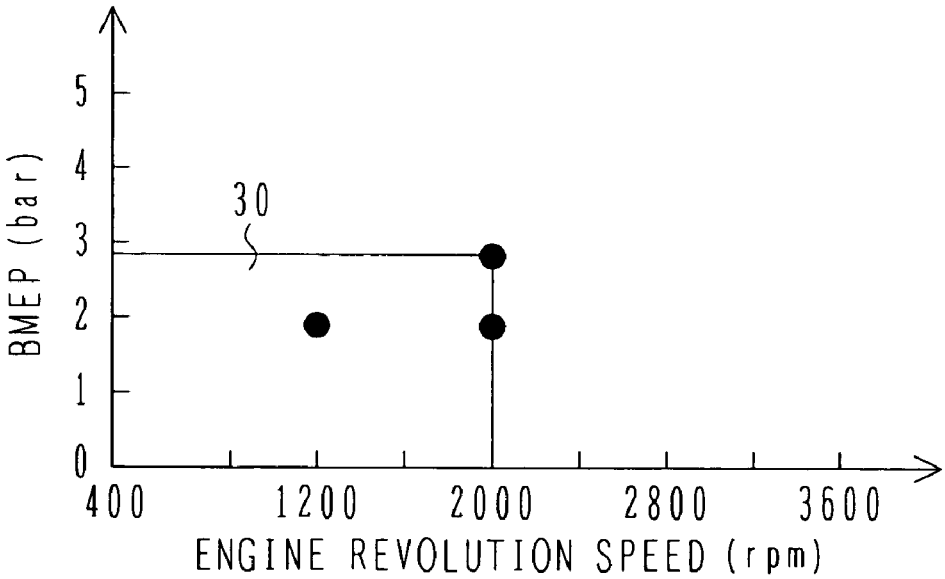
FIG. 12 is a graph showing a region where the effect of combustion control with the double ignition was confirmed.

On the other hand, when the engine load is increased, the air amount is increased and temperature rises, thus resulting in a tendency to improve ignitability. FIG. 11 shows the results of experiments conducted on the relationship between the ignition energy and the combustion variation index σPi under conditions of a larger load than that in the case of FIG. 2. Under the conditions in the case of FIG. 11, there is no significant mutually sensitive relation between σpi and the ignition energy, and stable combustion is obtained even at a low level of the ignition energy. If firing is actually started with IGN1 in spite of reducing the energy of E1 (mJ), too early firing is resulted, which may cause knocking or torque variations. For that reason, the double ignition has to be inhibited under those conditions. FIG. 12 shows a region where the effect of the double ignition was confirmed by the inventor. In FIG. 12, each point indicated by a mark "●" represents the conditions under which the effect of the double ignition was confirmed by the experiments. In other words, the double ignition can be performed with the satisfactory effect in an area 30, i.e., until reaching the engine revolution speed of 2000 rpm and the engine load (BMEP) of about 3.0 bar.

Another embodiment of the present invention will be described below. In the chart of FIG. 10 showing the concept of the double ignition, the charge period T2 required for providing the ignition energy E2 (mJ) of IGN2 has to be prolonged depending on specifications of the ignition coil. However, the setting range of T2 is limited based on the relation to ΔT. If the ignition energy of the main ignition IGN2 becomes smaller than E2 (mJ) in the present invention, there is a risk that satisfactory combustion stability cannot be ensured. Such a risk can be overcome by using a hybrid coil constructed as follows.

Figure 13:
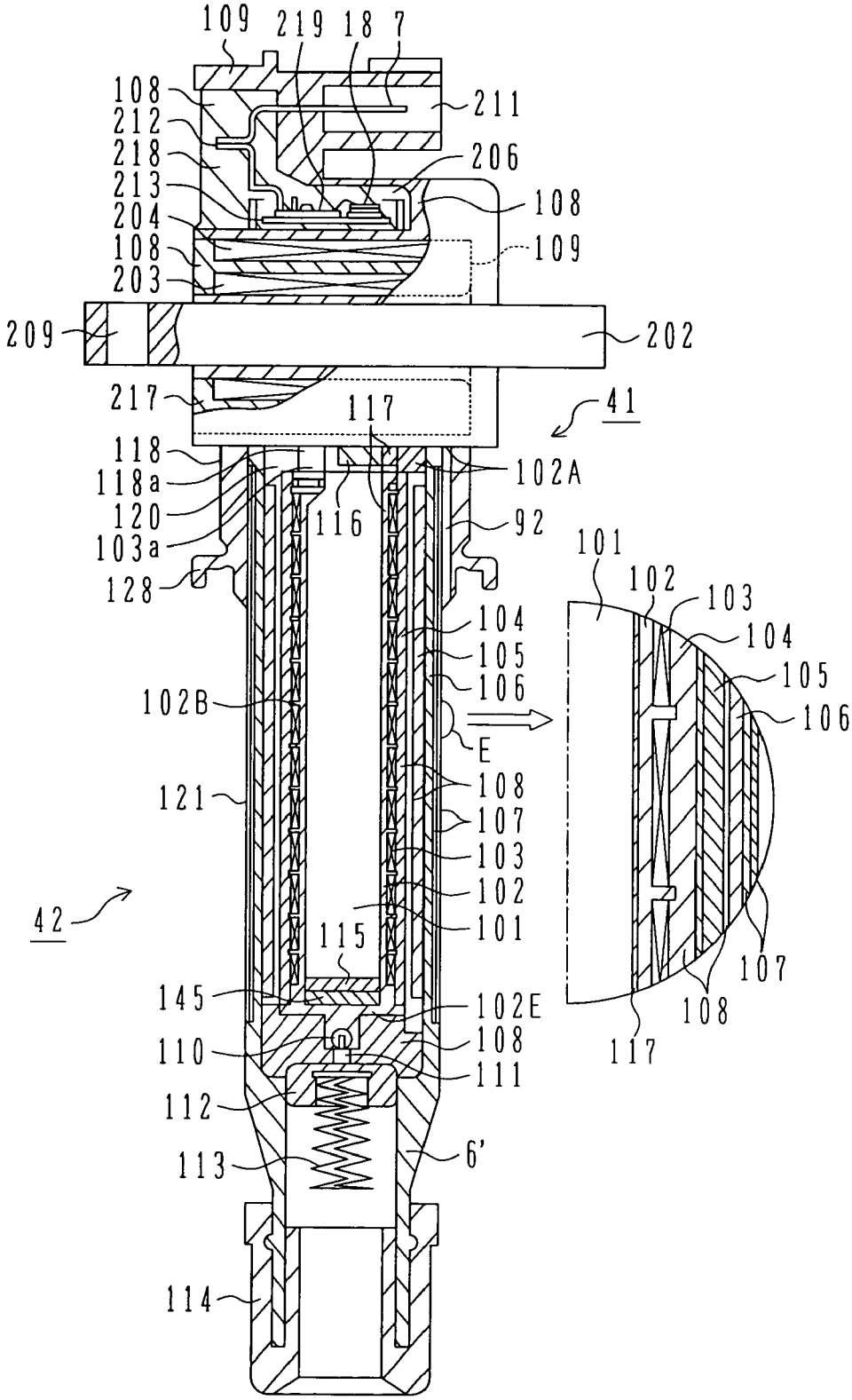

FIG. 13 shows the structure of a hybrid coil in which a preliminary pre-ignition coil and a main ignition coil are separately constructed and integrally built in one ignition coil case.

Inside a slim cylindrical coil case (outer case) 106, a center core 101, a secondary bobbin 102, a secondary coil 103, a primary bobbin 104, and a primary coil 105 are successively arranged in this order in a direction from the center (inner side) toward the outer side. A soft epoxy resin (called soft epoxy or flexible epoxy) 117 is filled in a gap formed inside the secondary bobbin 102 between the center core 101 and the secondary bobbin 102. Also, an epoxy resin 108 is filled in a gap between the secondary coil 103 and the primary bobbin 104 and a gap between the primary coil 105 and the coil case 106.

The reason why the soft epoxy 117 is used as a resin for insulation between the center core 101 and the secondary bobbin 102 is as follows. An independently-ignited ignition coil unit (pencil coil) fitted in a plug hole is exposed to severe temperature environment (thermal stress caused by temperature change of about −40° C. to 130° C.). Also, there is a large difference between the thermal expansion coefficient ($13\times10^{-6}$ mm/° C.) of the center core 101 and the thermal expansion coefficient ($40\times10^{-6}$ mm/° C.) of the epoxy resin. Accordingly, if an ordinary epoxy resin for insulation (i.e., an epoxy resin with a composition being harder than the soft epoxy 117), a risk may occur in that the epoxy resin is cracked due to the heat shock and dielectric breakdown is caused. Thus, the soft epoxy 117 being an elastic material superior in absorbing the heat shock and having insulation is used in order to ensure resistance against the heat shock.

The soft epoxy 117 has a mixed composition of, for example, an epoxy resin and modified aliphatic polyamine (with a mixing ratio of e.g., 1:1 by weight, namely 100 weight parts of the epoxy resin and 100 weight parts of the modified aliphatic polyamine). The soft epoxy 117 is molded in accordance with the following process.

By way of example, after inserting the center core 101 in the secondary bobbin 102, they are placed in a vacuum chamber and an inner space of the vacuum chamber is evacuated to create a vacuum state (e.g., 4 Torr). Under that vacuum state, the soft epoxy 117 is poured and filled in liquid phase between the secondary bobbin 102 and the center core 101. Then, the poured soft epoxy 117 is heated in the atmosphere at 120° C. for 1.5 to 2 hours for hardening.

With the above-described process, because the soft epoxy 117 poured in the vacuum state is placed under the atmospheric pressure during the heating and hardening step, the soft epoxy 117 filled between the secondary bobbin 102 and the center core 101 is subjected to pressure forming (compression forming) due to the differential pressure between the vacuum pressure and the atmospheric pressure during the heating and hardening step.

As an alternative, the center core 101 may be inserted in the secondary bobbin 102 after wrapping the center core 101 with silicone rubber in advance, and an epoxy resin 108 may be filled between them. Also with this method, because a soft damping layer is formed between the center core 101 and the epoxy resin 108 which has been poured and molded, the epoxy resin 108 can be prevented from contacting with a hard edge of the center core 101 and cracking due to the difference in thermal expansion between the center core 101 and the epoxy resin 108 after the epoxy resin 108 has been hardened.

As shown in FIG. 13, a connector-equipped coil case 109 is coupled at its bottom to a top of the cylindrical coil case 106 with fluid communication held between them. The epoxy resin 108 is also poured into the coil case 106 through the interior of the connector-equipped coil case 109 so as to fill a gap between the secondary coil 103 and the primary bobbin 104 and a gap between the primary coil 105 and the coil case 106, followed by heating and hardening.

The thus-filled epoxy resin 108 ensures insulation between the secondary coil 103 and the primary bobbin 104 and between the primary coil 105 and the coil case 106. While the aforesaid epoxy resin 117 is soft (flexible), the epoxy resin 108 filled over the former is harder than the so-called soft epoxy.

Further, the epoxy resin 108 is similarly filled in other spaces of the connector-equipped coil case 109, i.e., a space for accommodating a secondary coil 203 and a primary coil 204, and cavities 217 and 218 for accommodating an igniter 213 which includes an ignition circuit unit 206 and other necessary circuit parts, the ignition circuit unit 206 containing a semiconductor power switching device (IGBT), a current limiting circuit and other circuits all formed on a single silicon chip that is mounted onto a heat sink 213.

The secondary bobbin 102 in the cylindrical coil case 106 is disposed between the center core 101 and the secondary coil 103 and serves also to insulate a high voltage generated in the secondary coil 103. The material of the secondary bobbin 102 is a thermoplastic resin such as polyphenylene sulfide (PPS) or modified polyphenylene oxide (modified PPO). The above description is similarly applied to the secondary coil 203 and the primary coil 204 in the connector-equipped coil case 109.

The secondary coil 103 wound over the secondary bobbin 102 is formed of an enamel wire with a diameter of about 0.03 to 0.1 mm and has turns in number of about 5000 to 20000 in total with split winding.

The secondary bobbin 102 including the secondary coil 103 wound over it has an outer diameter smaller than the inner diameter of the primary bobbin 104 such that the secondary bobbin 102 and the secondary coil 103 are positioned inside the primary bobbin 104.

The primary bobbin 104 is also formed of PPS or modified PPO similarly to the secondary bobbin 102, or other suitable thermoplastic synthetic resin such as polybutylene terephtalate (PBT). The primary coil 105 is wound over the primary bobbin 104. In the case of using PPS, the primary bobbin 104 can be molded in a thin wall and has a wall thickness of about 0.5 mm to 1.5 mm. In addition, 50-70% by weight of inorganic power, such as glass fibers and talc, is mixed in the resin to minimize the difference in thermal expansion coefficient between the primary bobbin 104 and a metal in the primary coil 105.

The primary coil 105 is formed by winding an enamel wire with a diameter of about 0.3 to 1.0 mm in number of several tens per layer over several layers, and providing turns in number of about 100 to 300 in total.

The secondary coil 203 and the primary coil 204 both accommodated in the connector-equipped coil case 109 are formed so as to produce output energy at a level of about 70% of that produced by the secondary coil 103 and the primary coil 105.

The reason is that the coils in the connector-equipped coil case 109 are used only in the preliminary pre-ignition.

Taking into account the case where the coils in the connector-equipped coil case 109 are also used as a backup for the coils in the cylindrical coil case 106 in the event of disconnection in the latter, however, the coils in the connector-equipped coil case 109 may be wound with specifications capable of outputting the same level of energy as that outputted by the coils in the cylindrical coil case 106.

Preferably, the coils in the cylindrical coil case 106 are constructed of the magnetic-path open type in which a core of each coil is opened at both ends, and the coils in the connector-equipped coil case 109 are constructed of the magnetic-path closed type, from the viewpoint of holding a total volume smaller.

Note that, in an enlarged sectional view of a portion E in FIG. 13, the primary coil 105 is schematically shown as one layer for the convenience of drawing, but it is actually formed in several layers as described above.

The coil cases 106 and 109 are each molded of a thermoplastic resin, such as PPS, modified PPO or PBT, or a mixed resin prepared by mixing about 20% of modified PPO, as a compounding ingredient, in PPS ("sea-island" mixing mode with PPS being "sea" and modified PPO being "island") from the viewpoint of heat resistance.

Among those materials, the mixed resin prepared by mixing about 20% of modified PPO in PPS is preferable for the coil cases 106 and 109. The coil cases 106 and 109 made of the mixed resin have good adhesion with the epoxy resin 108 and is superior in not only voltage resistance, but also in moisture resistance and heat resistance (because PPS is superior in heat resistance, voltage resistance and moisture resistance, but it has poor adhesion with the epoxy resin when used alone, modified PPO having good adhesion with the epoxy resin is mixed to compensate for the disadvantage of PPS). Each of the coil cases 106 and 109 has a wall thickness of about 0.5 to 0.8 mm.

The center core 101 is formed by press-laminating a plurality of thin silicon steel sheets or directional silicon steel sheets having widths change in several stages and each having a thickness of about 0.3 to 0.5 mm, and it is inserted in an inner bore of the secondary bobbin 102.

The center core 202 is formed by press-laminating a plurality of thin silicon steel sheets or directional silicon steel sheets each having a thickness of about 0.3 to 0.5 mm, and it is inserted in an inner bore of the secondary coil 203.

A side core 107 is wrapped over an outer surface of the coil case 106 to constitute a magnetic path in cooperation with the center core 101. The side core 107 is formed by rounding a thin silicon steel sheet or directional silicon steel sheet having a thickness of about 0.3 to 0.5 mm into a tubular shape. To prevent one-turn shortening of magnetic flux in the side core 107, at least one axial slit is formed in the circumference of the side core 107. While this embodiment uses the side core 107 prepared by laminating a plurality (two in this embodiment) of silicon steel sheets with intent to reduce an eddy current loss and to increase an output, the side core 107 may be formed of one or more than two steel sheets. In other words, the number of steel sheets constituting the side core 107 is optionally selected depending on the material (e.g., aluminum or iron) of the plug hole, etc. Such a structure serves to compensate for the disadvantage of the open magnetic path arrangement.

The ignition coil thus constructed is mounted such that the cylindrical coil case 106 is inserted in the plug hole of the engine, and the spark plug is inserted in a silicone rubber boot 114 formed at a fore end of the ignition coil. The connector-equipped coil case 109 is projected above an engine head and is fixed to the engine head by utilizing a hole 209 bored through the center core 202. An ignition signal line, a power supply line, a ground line, etc. are connected to the engine control unit (ECU) through a connector 211. A main ignition coil 42 is formed in the cylindrical coil case 106, and a preliminary pre-ignition coil 41 is formed in the connector-equipped coil case 109. With the above-described structure of the ignition coil, the charge period T2 of IGN2 can be set without being affected by ΔT, and the required ignition energy E2 (mJ) can be ensured.

In this embodiment, an ignition coil section placed in the plug hole constitutes the main ignition coil for the reason that such an arrangement is advantageous in making smaller the coil section exposed to the exterior of the plug hole and lowering the center of gravity of the entire ignition coil.

As an alternative, the coil having a closed magnetic path and formed externally above the plug hole may be constituted as the main ignition coil. This arrangement is effective in the case where the diameter of the plug hole is so small that the number of turns of the coil inserted in the plug hole cannot be obtained at a sufficient level.

Figure 14:
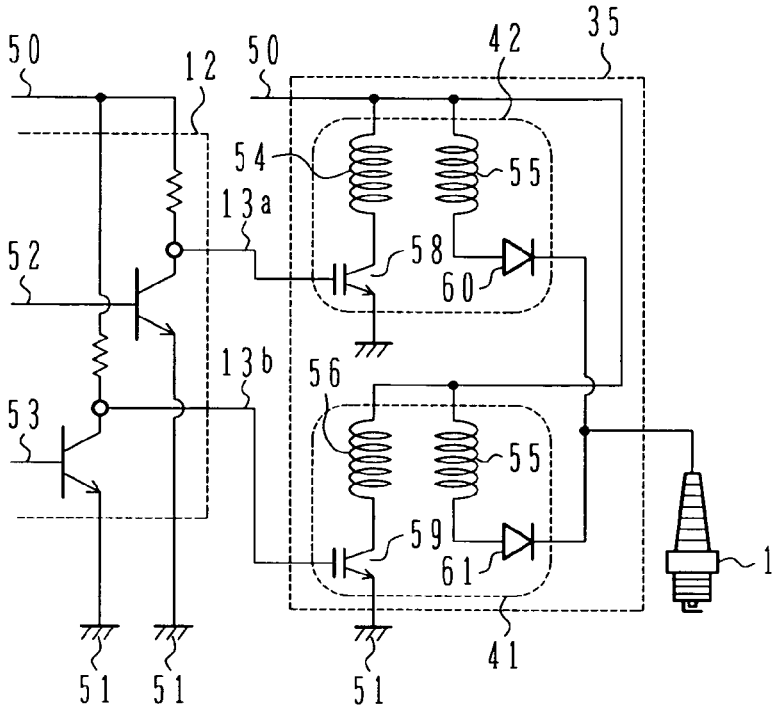
FIG. 14 is a circuit diagram showing a manner for connecting the hybrid coil and an ECU (Electronic Control Unit)

The circuit arrangement for separately outputting the ignition signal 13 to the preliminary pre-ignition coil 41 and the main ignition coil 42 from the ECU 12 will be described below. FIG. 14 shows a circuit for electrical connection between the ECU 12 and an ignition coil housing 35. The ECU 12 is indicated by a broken line on the left side, and it is connected to a power supply voltage via a line 50 and to the ground as indicated by 51. Reference numerals 52 and 53 denote ignition signals inside the ECU, which are outputted as 13*a* and 13*b* to the ignition coil housing 35, respectively. The interior of the ignition coil housing 35 is divided into the main ignition coil 42 and the preliminary pre-ignition coil 41, which are made up of respectively primary coils 54 and 56, secondary coils 55 and 57, power transistors 58 and 59, and backward-current blocking diodes 60 and 61. In each of those ignition coils, a current flows in accordance with the ignition signal from the ECU 12, whereby the ignition plug 1 performs the firing operation. The backward-current blocking diodes 60 and 61 serve to prevent secondary currents from flowing from the coil 41 to 42 or from the coil 42 to 41, instead of flowing toward the ignition coil 1, due to a time difference in the ignition timing between the two coils 41 and 42. Incidentally, the circuit diagram of FIG. 14 shows the firing operation per cylinder.

Figure 15:
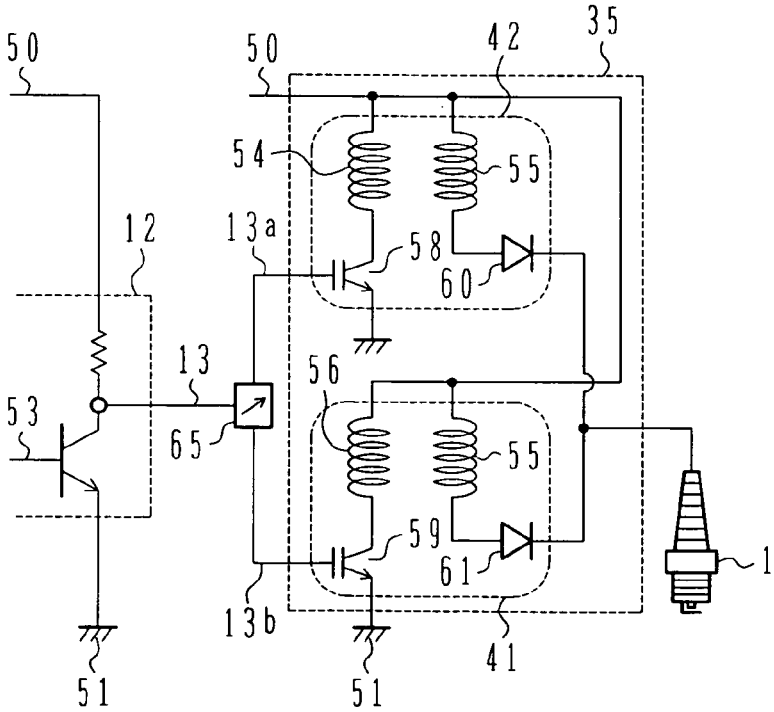
FIG. 15 is a circuit diagram showing a manner for connecting the hybrid coil and the ECU.

FIG. 15 is a circuit diagram having another arrangement. With this arrangement, the interior of the ECU 12 is simplified in comparison with the case of FIG. 14, and the ignition signal 13 outputted from the ECU 12 is inputted to an ignition signal distributor 65. The ignition signal distributor 65 has the function of distributing the ignition signal 13, which is supplied in a time-serial manner, into an ignition signal 13*b* for the preliminary pre-ignition coil 41 and an ignition signal 13*a* for main ignition coil 42. Also, the ignition signal distributor 65 may include the function of preventing an abnormal current from flowing to the coil side by setting separate limit values for respective pulse widths of the ignition signals distributed to the two coils. If the timing of distributing the ignition signal is shifted, for example, to such an extent that the ignition signals 13*a* and 13*b* are distributed respectively to the preliminary pre-ignition coil 41 and the main ignition coil 42 in a reversed way, an excessive current flows through the preliminary pre-ignition coil 41, thus causing coil damage or too earlier firing. On the other hand, the main ignition coil 42 is supplied with a too small current and cannot produce the ignition energy, thus resulting in a possibility of misfire. To avoid that risk, an upper limit of the pulse width is set for the ignition signal 13*b* supplied to the preliminary pre-ignition coil 41, and a lower limit of the pulse width is set for the ignition signal 13*a* supplied to the main ignition coil 42. With the circuit arrangement described above, the double ignition control can be executed using the hybrid ignition coil.

In the engine of this embodiment, the preliminary pre-ignition is performed before the main ignition timing. The preliminary pre-ignition activates the gas mixture (namely, forms the fire seed for easier firing), and then the main ignition coil starts firing of the activated gas mixture, to thereby cause main burning. Thus, since the gas mixture is brought into a firing easier startable state before reaching the optimum ignition timing, the gas mixture can be positively fired by the main ignition with less misfires, and the ignition timing is always kept at the optimum ignition timing.

As a result, an engine having good combustion stability and reliably generating appropriate torque can be provided.

More specifically, one spark plug and one ignition coil are provided per cylinder. When performing a plurality of ignitions during the compression stroke in the cylinder, before the main ignition that is performed at the proper timing depending on the operating conditions of the engine, at least one preliminary pre-ignition is performed with smaller ignition energy than that of the main ignition. As a result, the fire seed formed around the spark plug by the preliminary pre-ignition is diffused to the whole of the combustion chamber of the engine, whereby firing with the main ignition is ensured and the burning velocity is increased. As additional advantages, misfire can be avoided and the combustion stability can be improved.

The present invention is not limited in application to the in-cylinder injection engine, and can also provide similar advantages when applied to a port injection engine.

Further, while the above description has been made in connection with the structure including two ignition coils, one ignition coil may be used to perform a plurality of ignitions. Also in such a case, a current pulse for performing the last ignition is set to have a maximum pulse width so as to provide a maximum level of ignition energy.

What is claimed is:

1. An ignition coil for use in the spark ignition engine comprising one spark plug and a plurality of ignition coils per cylinder assembled into a single unit and performing a plurality of ignitions during a compression stroke of each cylinder, wherein main ignition is performed at main ignition timing decided depending on the operating conditions of said engine, at least one preliminary pre-ignition is performed before the main ignition on of said ignition coils outputs energy for the main ignition and another of said ignition coils energy for the preliminary pre-ignition, wherein one of said plurality of ignition coils is constituted as a cylindrical ignition coil inserted in a plug hole, and another is constituted as a horizontally oriented ignition coil mounted on said cylindrical ignition coil and has a second center core arranged in a direction to cross a first center core of said cylindrical ignition coil.

2. An ignition coil for use in the spark ignition engine according to claim 1, wherein said cylindrical ignition coil and said horizontally oriented ignition coil are accommodated in one housing, and a connector having terminals for supply of electric power to said two coils is integrally mounted to said housing.

* * * * *